United States Patent [19]

Lemmer

[11] 4,345,225

[45] Aug. 17, 1982

[54] SWITCH

[75] Inventor: Helmut Lemmer, Marienheide, Fed. Rep. of Germany

[73] Assignee: Starkstrom Gummersbach GmbH, Marienheide, Fed. Rep. of Germany

[21] Appl. No.: 242,854

[22] Filed: Mar. 12, 1981

[30] Foreign Application Priority Data

Mar. 13, 1980 [EP] European Pat. Off. ..... 80/101315

[51] Int. Cl.[3] ..... H01H 67/02

[52] U.S. Cl. ..... 335/132; 335/202

[58] Field of Search ..... 335/132, 133, 202, 278

[56] References Cited

U.S. PATENT DOCUMENTS

| | | | |
|---|---|---|---|
| 3,962,658 | 6/1976 | Zunft | 335/132 |
| 4,137,559 | 1/1979 | Reuting | 335/132 |
| 4,254,316 | 3/1981 | Landow | 335/132 |

*Primary Examiner*—George Harris

*Attorney, Agent, or Firm*—Allison C. Collard; Thomas M. Galgano

[57] ABSTRACT

In a switch or relay and, more particularly, a power or auxiliary switch or relay with a contact system mounted in a housing, as well as a magnet system which actuates the contact system, considerable difficulties are encountered when the contacts of the contact system are disposed in at least two planes which are disposed at different distances from the mounting plane. In such a case, the contact connecting zones which are facing away from the mounting plane are covered by the wiring for the contact connecting screws which are further displaced from the mounting plane and therefore are not accessible. Since switches or relays of this type are usually installed in large numbers in rows and in a compact arrangement with respect to each other in switch or relay boxes, a predetermined standard width for the switches or relays should not be exceeded. The employed switch or relay boxes are subjected to considerable shocks during transport to the installation site, so that the total wiring and the firm seating of the contact connecting screws must be checked before operation. In order to enable a simple handling of the wiring possibilities for the contacts and to also enable alternate installation of the wiring on the upper or on the lower contact connecting screws, or vice versa, without increasing the limited width of the switch or relay boxes, as is the case in actual practice, regardless of the number of poles, the switch or relay chambers are laterally displaced with respect to each other within the common flat side faces of the housing, while simultaneously maintaining the predetermined width from plane to plane, so that each contact connecting screw is freely accessible at the different distance planes of the installed wiring.

11 Claims, 12 Drawing Figures

SWITCH

The invention relates to a switch, relay or contactor. More particularly, it relates to a power or auxiliary switch, relay or contactor with a housing, a contact system and a magnetic system which actuates the contact system mounted in the housing, and a cover for closing the housing at the end facing away from its mounting side. The invention especially relates to such a switch wherein the contact system further comprising contact bars with contact connecting screws and stationary contact elements, as well as commonly actuable bridges with movable contact members which act as opening and/or closing devices, wherein the contacts of the contact system are disposed in two different planes at different distances from the mounting plane and wherein each bridge together with the movable contact members and the associated contact bars with the stationary contact elements are mounted in a limited switch chamber.

Switches (as used herein, this term refers to switches, relays or contactors) of the aforementioned type are known in many types. In all of these switches, the fundamental disadvantage is that the connecting possibilities for the wiring are very cumbersome. Normally, switches are mostly installed in a row in tight disposition with respect to each other in switch boxes, whereby the mounting planes usually run vertically in the form of U-shaped mounting bars. In this case, the switches are generally mounted in parallel rows in a tight disposition next to each other, so that the connecting lines run upwardly and downwardly and are combined in conduits between the row of switches. In all hitherto switches of the aforementioned type, the contacts, in particular, the contact screws for the wiring are mounted in a superimposed manner with respect to each other, that is, in planes perpendicular with respect to the mounting plane of the switch box while the contact connecting screws run in two or more planes parallel with the mounting plane. In practical application, it is therefore mandatory that initially, the wiring is made on the contact screws which are in a plane next to the mounting plane and, thereafter, the wiring is carried out on the contact screws which are farther removed from the mounting plane of the switch box.

Such a factory assembled switch box is subjected to shocks during transport to the installation site, so that it is mandatory that all contact connections are checked with respect to the firm seating and contact safety after the switch box is installed. In practical application, this has been shown to be very cumbersome, since the wiring of the contact connecting screws of the outer plane makes the accessibility to the contact screws of the lower plane or planes very difficult. Therefore, one is forced to remove the wiring of the outer plane, in order to secure the contact screws which are mounted below, in order to assure a high degree of contact safety.

Another factor which comes into play and which makes this task even more difficult is that because of the predetermined standard width of the switches, a certain width cannot be exceeded because of the tight disposition of the switches in rows adjacent to each other on the corresponding switch box or the switch board. On the other hand, as many as possible contacts for obtaining a large switch program must be mounted in one switch. Finally, it is essential to provide a simple switch structure and thereby a very inexpensive structure for making the individual parts and for assembling the individual parts to form an operative switch. It is also important to provide a switch which affords simple operation and easy maintenance.

It is therefore an object of the invention to provide a switch which enables easy handling of the wiring possibilities for the contacts and in which the alternate wiring on the upper and lower contact connecting screws, or vice versa, may be carried out without increasing the limited width of the switches, regardless of the number of poles in the practical application.

This object of the invention is obtained in accordance with the invention in that the switch chambers are laterally offset with respect to each other within common plane side faces by maintaining a predetermined width from plane to plane, so that each contact connecting screw is freely accessible at the different distance planes of the provided wiring. In this manner, a simple installation operation during wiring is afforded. In addition, a further advantage is that not only a hand wiring but also a mechanical wiring may be carried out.

Other objects and features of the present invention will become apparent from the following detailed description when taken in connection with the accompanying schematic drawings which disclose several embodiments of the invention. It is to be understood that the drawings are designed for the purpose of illustration only and are not intended as a definition of the limits of the invention.

In the drawings, wherein similar reference characters denote similar elements throughout the several views.

Figure 3:
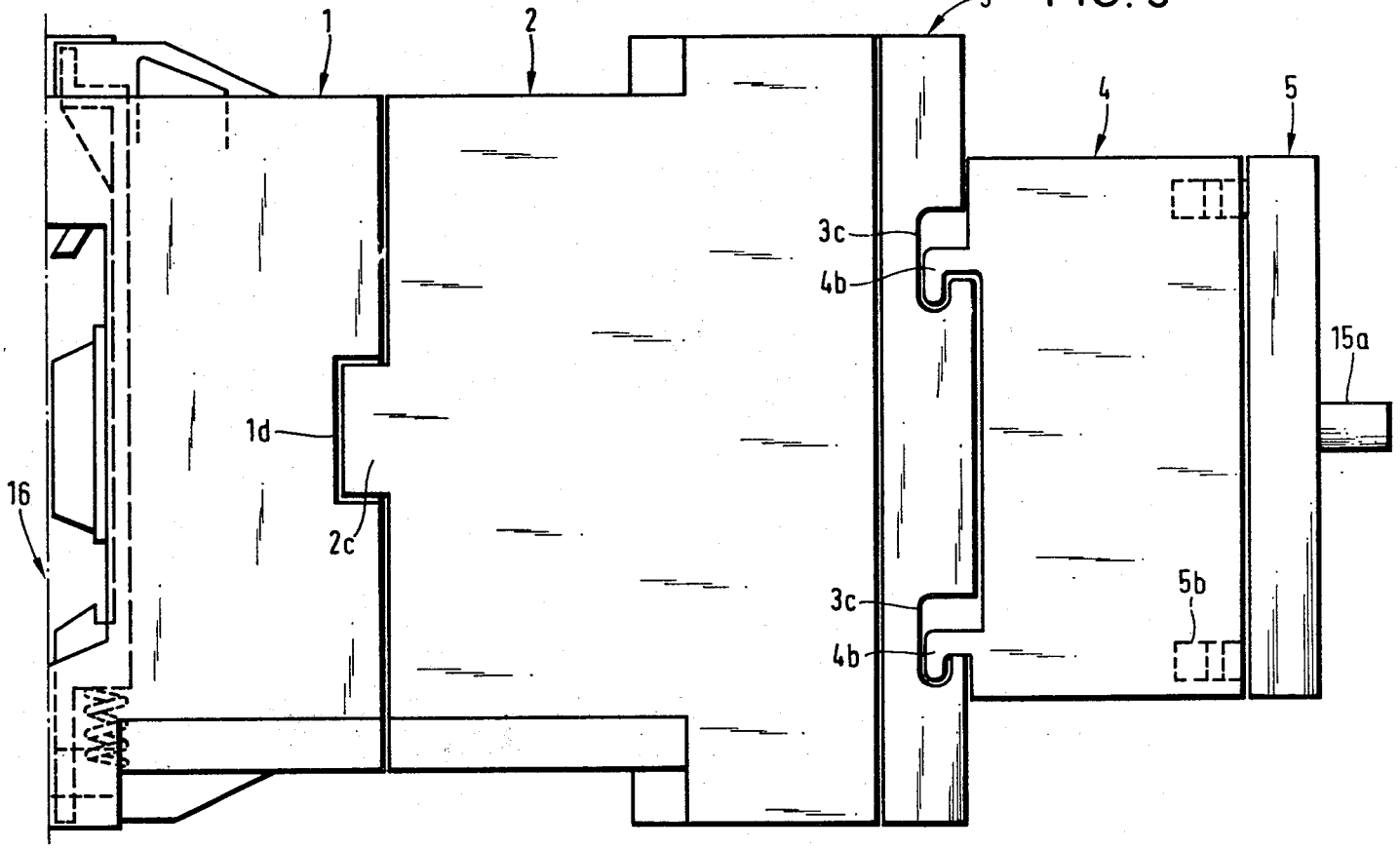
FIG. 3 is a side view taken in the direction of arrow III of FIG. 1.
Figure 6:
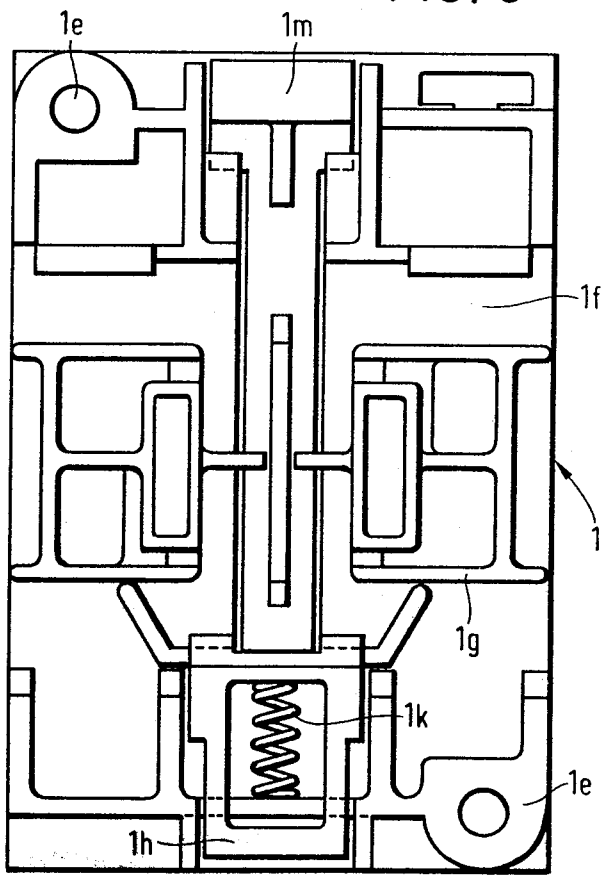
FIG. 6 is a bottom view of the switch taken in the direction or arrow VI of FIG. 1.
Figure 7:
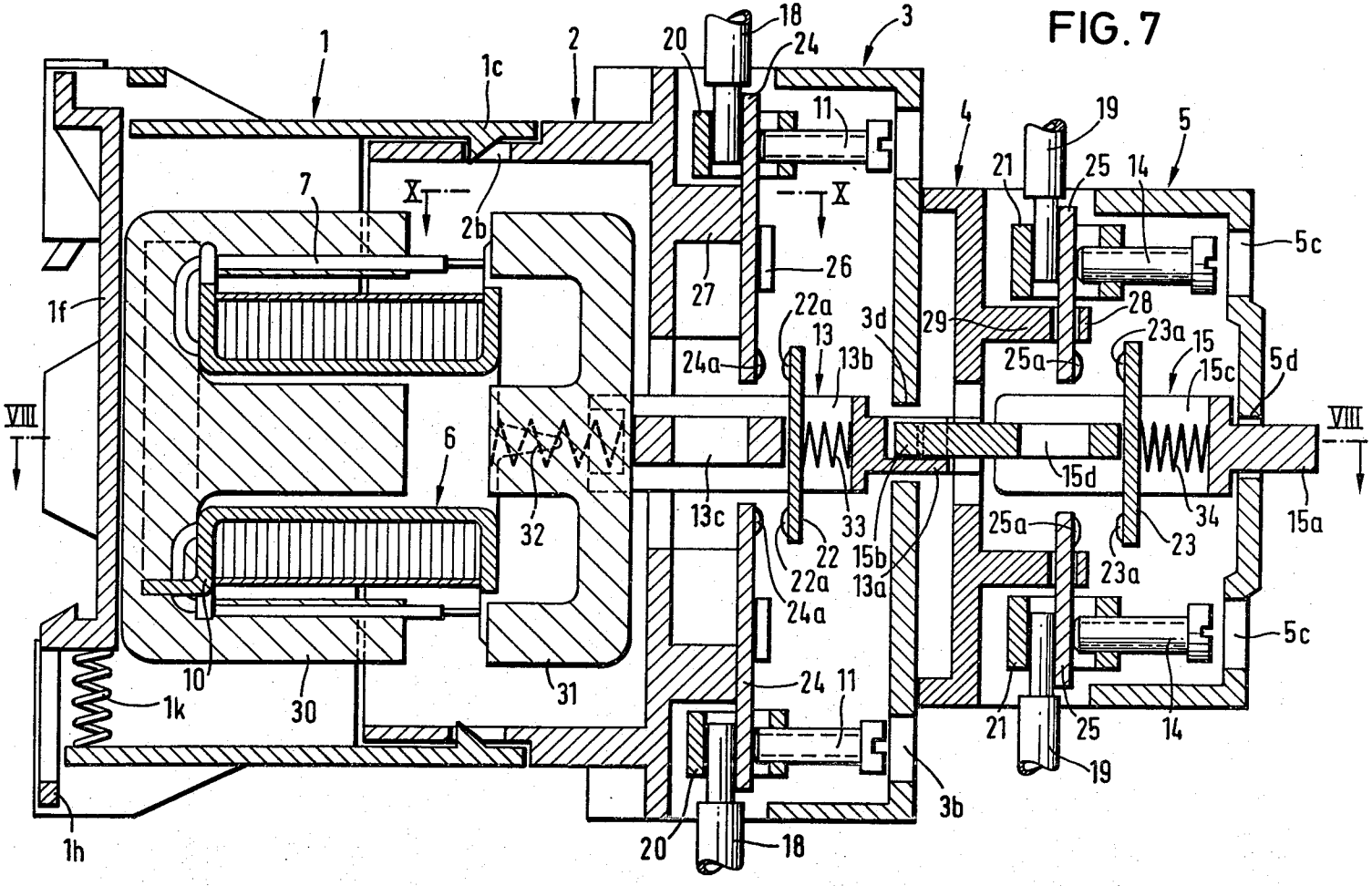
FIG. 7 is a longitudinal sectional view through the switch taken along line VII—VII of FIG. 1.
Figure 8:
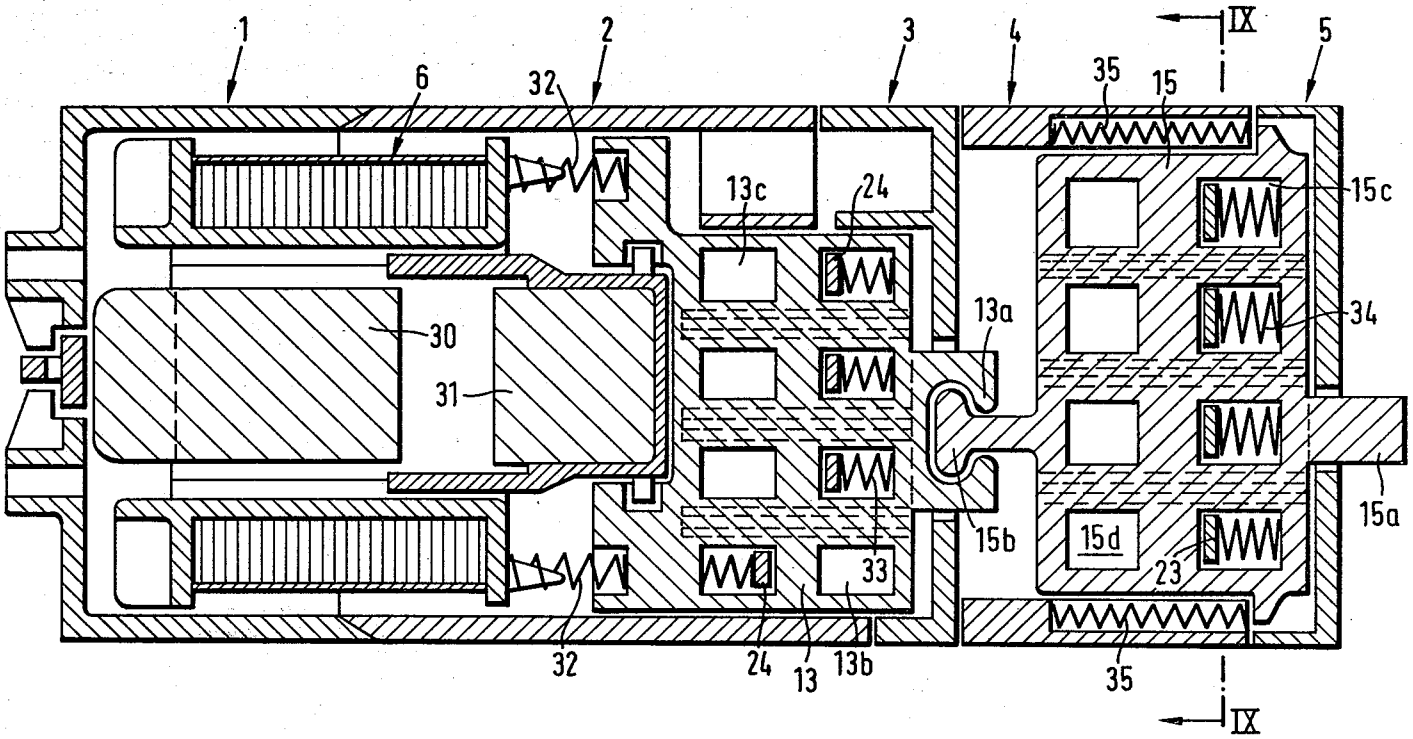
FIG. 8 is a cross-sectional view taken along line VIII—VIII of FIG. 7.
Figure 9:
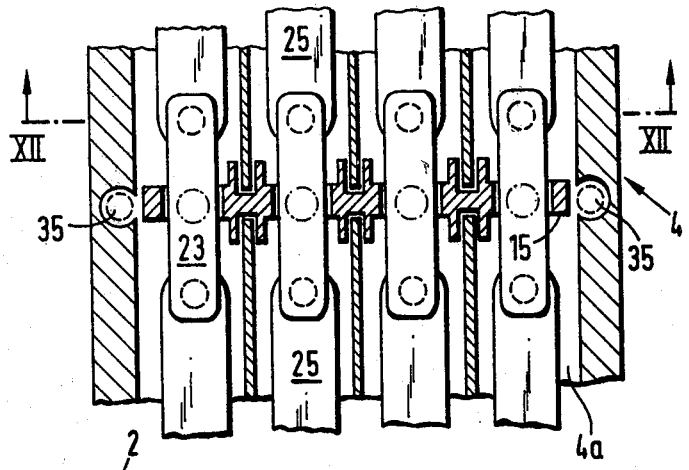
FIG. 9 is a fragmentarily-illustrated sectional view taken along line IX—IX of FIG. 8.

The embodiment shown in the drawings illustrates a switch, relay or contactor with a housing made of tough hard plastic which consists of housing parts 1, 2, 3, 4 and 5. Housing part 1 is provided with an associated bottom plate 1*a* by which it may be mounted on a mounting plane, for example, on a switch board or in a switch box. The mounting plane is shown as a simplified dash-dotted line 16 in FIG. 3. For mounting, the lateral projections 1*e* with bores may be used or, alternatively, a bolt 1*h* may be used which is subjected to the force of a compresson spring 1*k* (FIG. 6) and which engages together with a counter abutment into a profiled track of the switch board or the switch box (not shown). On the lower side 1*f* of the bottom, guide or reinforcing ribs 1*g* may be provided. In the interior of housing part 1, the magnet system is mounted which, on the one hand, consists of a coil 6 with connecting lines 7 and connecting members 8, 9 and, on the other hand, a magnet core 30 and a movable armature or pole 31, as shown in FIG. 7. The mounting of the coil 6 and the armature core 30 may be carried out with the assistance of a mounting or holder 10 by simple insertion under a clamping effect.

Resilient flanges or blades 1*c* are provided on the upper and lower sides of housing part 1 which cooperate with recesses and ratchet points 2*b* of housing part 2. Blade-like projections 2*c* are also mounted on the two side faces of housing part 2 which cooperate with recesses and ratchet points 1*d* of housing part 1. Thereby, housing parts 1 and 2 can be connected with each other by a simple manual pushing together.

Figures 1, 2:
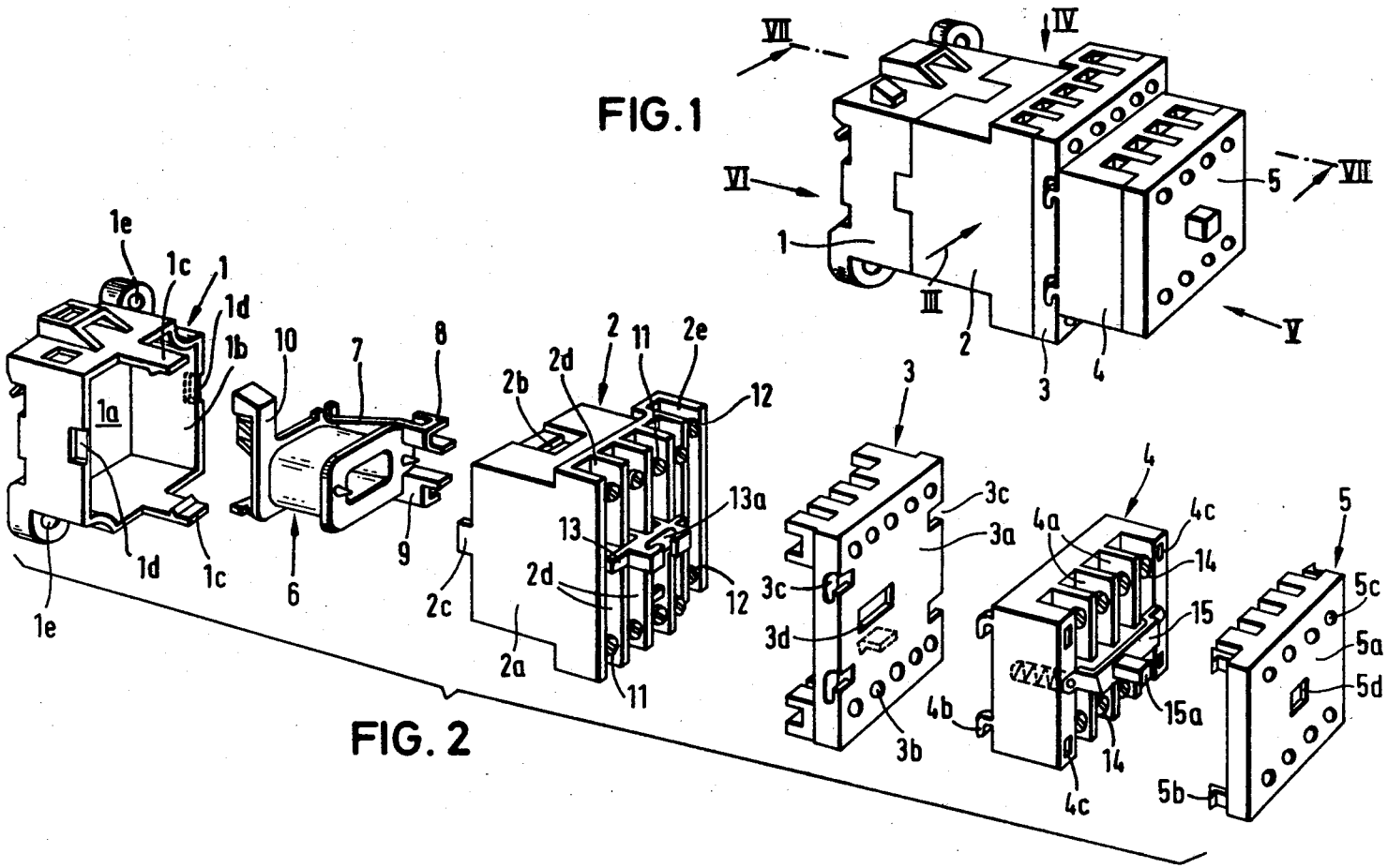
FIG. 1 is a perspective view of an assembled switch, relay or contactor embodying the present invention.
FIG. 2 is an exploded perspective view of the individual parts of the switch in accordance with FIG. 1, with the magnet armature being omitted.
Figure 4:
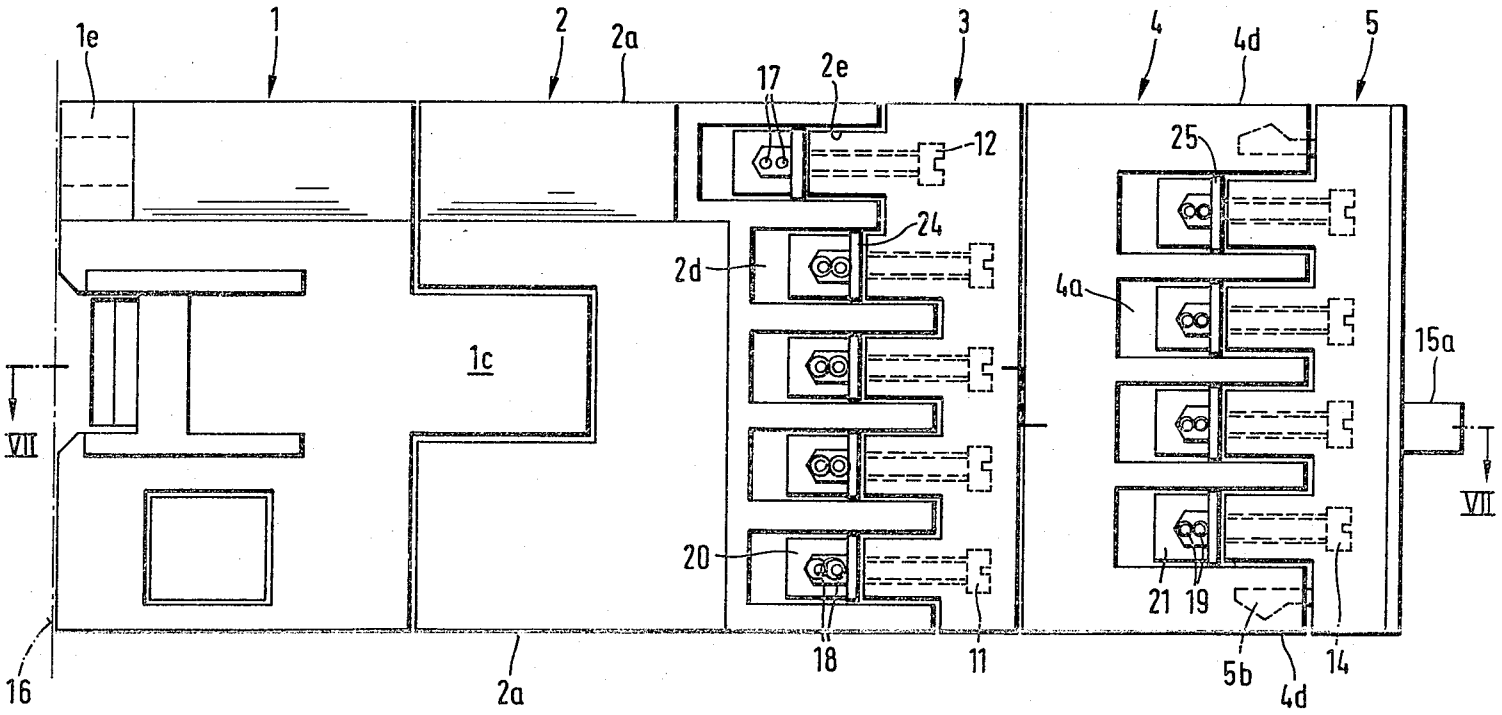
FIG. 4 is a plan view taken in the direction of arrow IV of FIG. 1.

Housing part 2 contains a contact system. For this purpose, and within the predetermined width, four adjacent and parallel switch chambers 2*d* are provided between side walls 2*a* (FIG. 4) spaced from the mounting plane 16 for small switch capacities or contact ratings of about 4 to 4.5 kw. As can be seen in particular in FIG. 2, switch chamber walls are provided which define U-shaped grooves with open front faces. Thereby, the U-shaped grooves open to the side facing away from the mounting plane. In each switch chamber, two contact bars 24 are provided with stationary contact members 24*a* which are retained therein by insertion between guides 26, 27 of housing part 2, as well as into an essentially right angular frame 20, in which they are held by means of contact screws 11. As can be seen in particular in FIG. 4, the openings of the frame 20 are chosen with such a low width that during the connection of a plurality of lines 18, 19, these lines may be tightly clamped in a superimposed manner in planes running perpendicular with respect to the mounting plane. A bridge 22 with movable contact members 22*a* cooperates with the two contact bars 24 of each switch chamber.

In the shown embodiment, closing devices are shown which may be converted into opening devices, if so desired, by turning the two contact bars 24 of the corresponding switch chamber by about 180°, so that contact members 24*a* are directed towards the mounting plane. Furthermore, bridge 22, together with contact spring 33, is removed from opening 13*a* of bridge support 13 and after turning by about 180° is again inserted into the opening.

Two rows of rectangular openings 13*b* and 13*c* are provided in the plate of bridge support 13, for inserting bridges 24 and springs 33 for an alternate opening or closing, as already mentioned before. On the end which faces away from the mounting face, bridge support 13 is provided with a C-shaped outwardly opening projection 13*a* which extends through an opening 3*d* of intermediary housing part 3. Housing part 3 covers the contact system in housing part 2. In intermediary cover 3, two rows of openings 3*b* are provided through which one can insert a screwdriver which would be guided by the corresponding wall of the bore, so that contact connecting screws 11 are freely accessible for mounting.

In addition to the switch chambers 2*d* of housing part 2, a further groove-like space 2*c* is provided within the predetermined width, wherein the two connecting screws 12 for the coil of the magnet are mounted, aligned with the rows of contact connecting screws 11; however, they are offset a little bit towards the mounting plane for a easier recognition. Two further openings 3*b* are provided aligned with the aforementioned bores for a free access to the screws 12 in housing part 3. Housing part 3 may be mounted by clamping or sliding onto housing part 2.

A further housing part 4 is mounted on housing part 3 which has four adjacent switch chambers 4*a* wherein, as can be seen in particular in FIGS. 1, 7, 8, 9 and 12, contact bars 25 with stationary contacts 25*a*, as well as bridges 23 with movable contact members 23 are mounted together with a common bridge support 15. On the outer end of bridge support 15, an actuating button 15*a* is provided which extends through an opening 5*d* of the outer housing part 5, while the other end of the bridge support 15 is provided with a T-shaped projection 15*b* which engages into the C-shaped projection 13*a* when mounting housing part 4 onto housing part 3 by means of a lateral displacement. Simultaneously, and also by a lateral displacement, a connection between housing part 3 and housing part 4 is established. For this purpose, recesses 3*c* are provided in the outer face 3*a* of housing part 3 and hook-like projections 4*b* are provided depending from housing part 4. The mounting position of these housing parts is clearly shown in FIG. 3.

Figure 5:
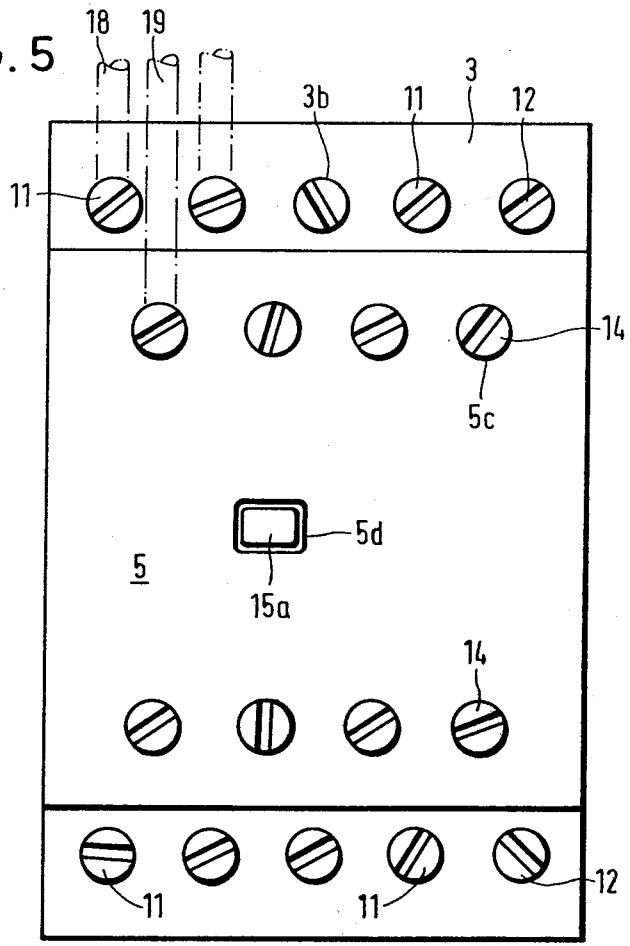
FIG. 5 is a front view taken in the direction of arrow V of FIG. 1.

The guides and mounts 21, 28 and 29 for the contact bars 25, the shape of the common bridge support 15 with openings 15*c*, 15*d*, as well as contact bars 25 with the stationary contact members 25*a* and bridges 23 with the movable contact members 23 basically correspond to the ones shown in housing part 2. However, the heightwise dimension of housing part 5, while maintaining the same width, is considerably less than at housing part 2, so that the two rows of contact connecting screws, as well as the two coil contact screws 12 are freely accessible from the front face of the switch according to FIG. 5, even if the wiring 18, 19 is completely installed.

For this aforementioned purpose, it is of utmost importance that the switch chambers in the two different planes, that is, in the housing part 2, on the one hand, and the housing part 4, on the other hand, are offset with respect to each other leaving a gap or space therebetween. This is shown best in FIGS. 4 and 8.

Housing part 4 is covered by a lid-like housing part 5 which again has blade-like projections 5*b*, which engage into recesses 4*c* with ratchet points provided in housing part 4, thus providing a secure mounting. The two rows of openings 5*c* permit insertion of a screwdriver for tightening the contact connecting screws 14. In addition to the compression springs 32, two further compression springs 35 may be provided on both sides of the common bridge support 15 in housing part 4. By using the two bridge supports 13 and 15 together with armature 31, the total contact system is actuated by the same magnet system.

Figure 10:
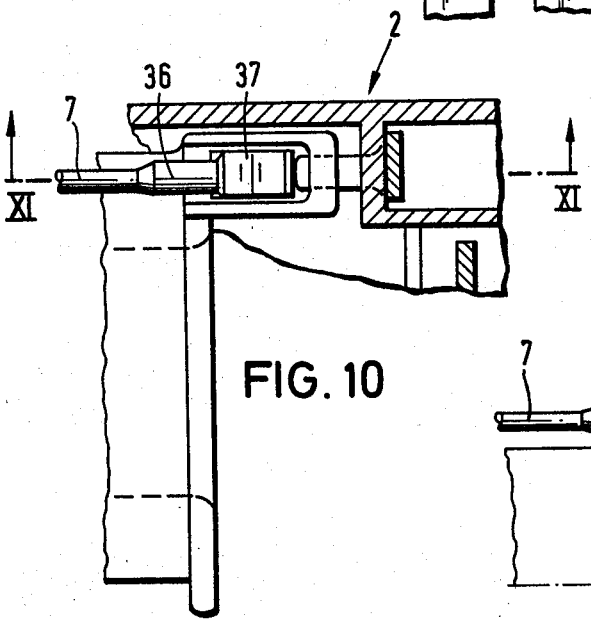
FIG. 10 is a fragmentarily-illustrated view taken along line X—X of FIG. 7.
Figure 11:
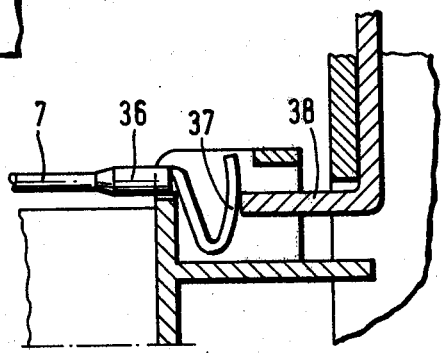
FIG. 11 is a cross-sectional view taken along line XI—XI of FIG. 10.
Figure 12:
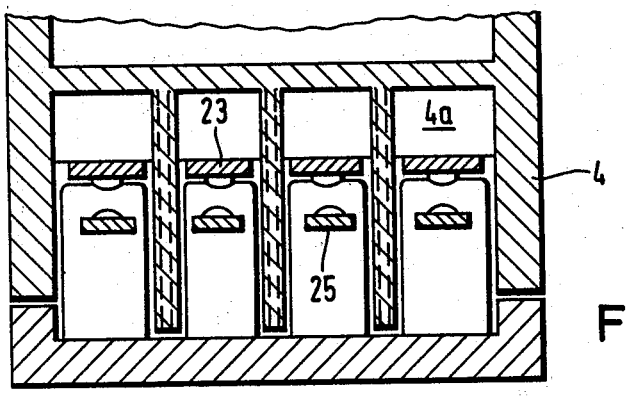
FIG. 12 is a fragmentarily-illustrated view taken along line XII—XII of FIG. 9.

FIGS. 10 and 11 show the electrical connections between the coil connecting lines 7 and screw contacts 12 which is effected via amplification member 36 and a spring yoke 37 which engages a connecting line 38 which leads to the corresponding contact screw 12. The electrical connection between contact screws 12 and coil 6 is assured when housing parts 1 and 2 are assembled.

The switch may be changed over to a different switch capacity or contact rating in a simple manner. If instead of the four switch chambers 2*d* and 4*a* in two spaced-apart planes having a switch capacity of about 4 to 4.5 kw, a higher switch capacity of about 11 kw is demanded, one can exchange the corresponding housing parts 2 to 5, together with the associated contact system by other housing parts with three switch chambers per distance plane, which would be larger due to the higher switch capacity but which would maintain the predetermined width. These switch chambers would also be offset with respect to each other from distance plane to distance plane, forming openings therebetween, so as to assure a free accessibility to all contact connecting screws when the wiring is again installed.

Thus, while only one embodiment of the present invention has been shown and described, it will be obvious that many changes and modifications may be made thereunto, without departing from the spirit and scope of the invention.

What is claimed is:

1. In a switch used as a power or auxiliary switch or the like of the type including a housing having a mounting side, a contact system mounted in said housing, a magnetic system which actuates the contact system mounted in the housing and a cover which closes the housing at an end thereof facing away from its mounting side, wherein said contact system further comprises contact bars coupled to contact connecting screws and stationary contact members, as well as commonly actuable bridges with movable contact members which cooperate with said stationary contact members to act as opening and/or closing devices, wherein the contacts of said contact system are disposed in at least two different planes at different distances from the mounting plane defined by said mounting side, and wherein each bridge together with the associated movable contact members and the associate contact bars, with the stationary contact elements are each mounted in a limited switch chamber, the improvement comprising:

said switch chambers at each plane being laterally offset with respect to each other while having commonly aligned plane side faces which define a predetermined constant width from plane to plane, so that each contact connecting screw is freely accessible in the different distance planes of the wiring to be secured by said contact connecting screws.

2. The switch according to claim 1, wherein said housing comprises a multiplicity of housing parts and wherein the switch chambers of each distance plane are disposed adjacent to each other in common housing parts, and wherein said housing parts are detachably connected with the adjacent housing parts without screws by means of plug-in connections.

3. The switch according to claim 1 or 2, wherein said switch chambers are provided in two separate planes disposed parallel to and spaced from said mounting plane, wherein a multiplicity of spaced-apart contact connecting screw pairs are provided at each plane, each pair of which is mounted within a separate switch chamber and wherein at each plane a pair of coil connecting screw pairs are provided in a chamber adjacent to said switch chambers of said contact connecting screws, and wherein switch chambers of the plane farthest from the mounting plane are disposed with an opening with respect to the switch chamber and the coil connecting screws of the other plane.

4. The switch according to claim 1, 2 or 3, wherein said chambers have walls which define U-shaped grooves with open front faces.

5. The switch according to claim 4, wherein said front face of said U-shaped grooves open to the sides of said switch chambers facing away from the mounting plane.

6. The switch according to claim 2, wherein said plug-in connections of the housing parts comprise transversely-yielding blades having barbed hooks provided on one housing part and cooperating engagement points provided on the other housing part.

7. The switch according to claim 1, 2 or 6, wherein said switch chambers of each distance plane are each covered by a cover.

8. The switch according to claim 7, wherein one of said covers comprises an intermediary cover disposed between two adjacent switch chamber housing parts provided with recesses on its side facing away from the mounting plane and wherein one of said adjacent switch chamber housing parts has hook-like projections facing the mounting plane which cooperate, by a lateral displacement, with said recesses.

9. The switch according to claim 8, wherein said bridges together with said movable contact members of each switch chamber housing parts are retained in a common bridge support, wherein the bridge support of one switch chamber housing part is provided with a C-shaped outwardly opening projection, wherein the bridge support of the other switch chamber housing part is provided with a T-shaped projection which, by a lateral displacement, engages the C-shaped projection, and wherein said intermediary cover is provided with an opening through which one of said projections may extend.

10. The switch according to claim 1, wherein said contact connecting screws are mounted in substantially rectangular frames having openings which have such a low width that the electrical lines may be clamped tightly therein in superimposed planes disposed perpendicularly with respect to the mounting plane.

11. The switch according to claim 10, wherein said contact bars with said stationary contact elements are retained in switch chamber housing guides, said contact having one end secured in said rectangular frame by means of said contact connecting screw.

* * * * *